United States Patent [19]

Rich

[11] 4,300,721

[45] Nov. 17, 1981

[54] SYSTEM FOR COLLECTING LIQUID SPILLAGE AT RAIL FACILITIES

[75] Inventor: Brett Rich, Malad City, Id.

[73] Assignee: Oneida General Corporation, Malad City, Id.

[21] Appl. No.: 152,626

[22] Filed: May 23, 1980

[51] Int. Cl.[3] ..... E01B 1/00; E01C 9/06

[52] U.S. Cl. ..... 238/2; 238/8; 104/133; 134/123; 404/2

[58] Field of Search ..... 238/2, 3, 5, 8, 9, 6; 104/133; 134/123; 404/2, 3

[56] References Cited

U.S. PATENT DOCUMENTS

| | | | |
|---|---|---|---|
| 3,773,255 | 11/1973 | Schoulties | 238/2 |
| 3,866,830 | 2/1975 | Hein et al. | 238/8 |
| 3,878,987 | 4/1975 | Uzuka | 238/2 |
| 4,010,896 | 3/1977 | Stockton | 238/2 |

*Primary Examiner*—Richard A. Bertsch

*Attorney, Agent, or Firm*—Mallinckrodt & Mallinckrodt

[57] ABSTRACT

A system for collecting liquid spillage at rail facilities comprises relatively small and lightweight collector pan modules supported by the ties of a railroad track and sealingly joined together so as to extend alongside and between the rails of the track. The pans are individually formed to rest on the ties and for drainage empty into drain conduits provided between the ties.

10 Claims, 5 Drawing Figures

SYSTEM FOR COLLECTING LIQUID SPILLAGE AT RAIL FACILITIES

BACKGROUND OF THE INVENTION

1. Field

The invention is in the field of drainage systems for liquids, especially liquids inadvertently spilled during the filling or emptying of railway tank cars or the fueling of locomotives.

2. State of the Art

Massive drain systems of concrete or other structural materials are sometimes constructed at railway loading and unloading and at locomotive fueling sites to collect and dispose of spilled corrosive or inflammable liquids, which could otherwise accumulate in dangerous puddles. Such systems are undesirable for a variety of reasons. For example, they make track repairs difficult and, if damaged by derailments or otherwise, are expensive to replace.

BRIEF SUMMARY OF THE INVENTION

With the foregoing in mind, the present invention provides for the collection and drain off of spillage at loading and fueling sites of rail facilities by a construction made up of interfitted and caulked, spillage collector pan modules, each of which can be removably installed upon the ties of the railway track by a single workman. The pans, together, provide a continuous, spillage-receiving and collector deck between and alongside the rails of the track and provide drainage into drain conduits in the form of drain pipes or drain channels lying between the usual ties of the railroad track and along one side of the track so as to empty collected spillage into a storage tank or other salvage or disposal facility.

In a presently contemplated form of the invention, each pan module is shallow and constructed of a tough and strong, lightweight material, such as a high density polyethylene structural foam, to have a downwardly dished upper surface with a drain opening at the lowest level and with structural reinforcing ribs as a supporting base. A drain nipple depends from the opening and is preferably provided by screwing a short length of pipe thereinto. Other forms contemplated may differ in the drain opening, for example the pan may slope downwardly to drain over and along the lower end of the pan into a channel of trough formation.

Edge margins of each pan may be formed to connect in mating relationship with adjoining pans, but in any event they fit together to provide a leakproof deck surface. The overlapped or abutting joints are desirably sealed by the application of a caulking compound or may be rendered leakproof in some other manner. The pans are advantageously dimensioned so as to be sealable against the vertical webs of the rails and, together, to span or almost span the distance between such rail webs, the use of overlapping caps between adjoining pans being within the purview of the invention.

Accordingly, it is a principal object of the invention to provide an economical system for efficient collection and drain off of the aforementioned spillage, which system may be installed and non-destructively removed by one man.

Thus, both installation and subsequent repairs and maintenance of the system may be accomplished with no heavy or special equipment. Further, any damage to one or more of the collector pan modules is quickly and economically repairable, with no damage to ties, rails, or track bed, by replacement of the damaged modules.

THE DRAWINGS

In the accompanying drawings, which illustrate an embodiment presently contemplated as the best mode of carrying out the invention in practice:

FIG. 1 is a fragmentary perspective view of the spillage collector and drain system of the invention installed in conjunction with the railroad track at a loading or fueling site of an industrial rail facility;

FIG. 2, a fragmentary view in transverse vertical section taken along the line 2—2 of FIG. 1 and drawn to a considerably larger scale;

FIG. 3, a top plan view of one of the spillage collector pan modules of the invention;

FIG. 4, a perspective view of the pan module of FIG. 3 as turned upside down to show the bottom thereof; and FIG. 5, a longitudinal vertical section taken along the line 5—5 of FIG. 3.

DETAILED DESCRIPTION OF ILLUSTRATED EMBODIMENT

Figure 1:
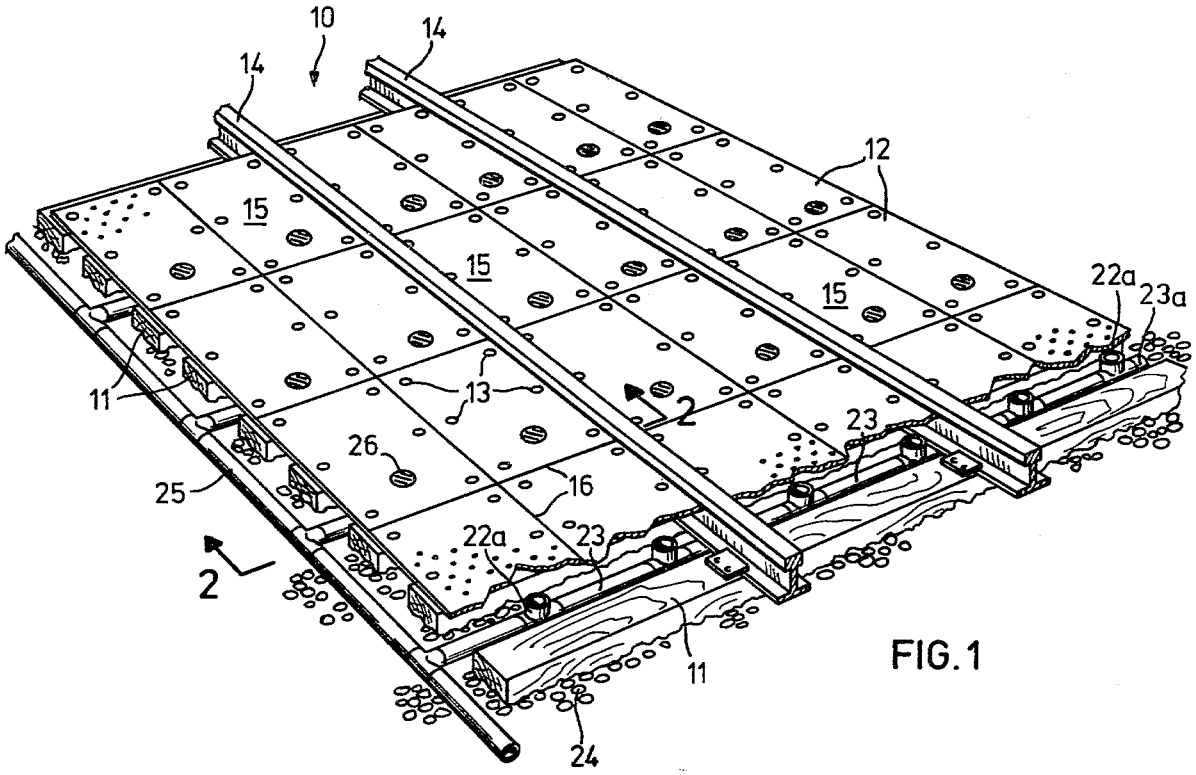
Figure 3:
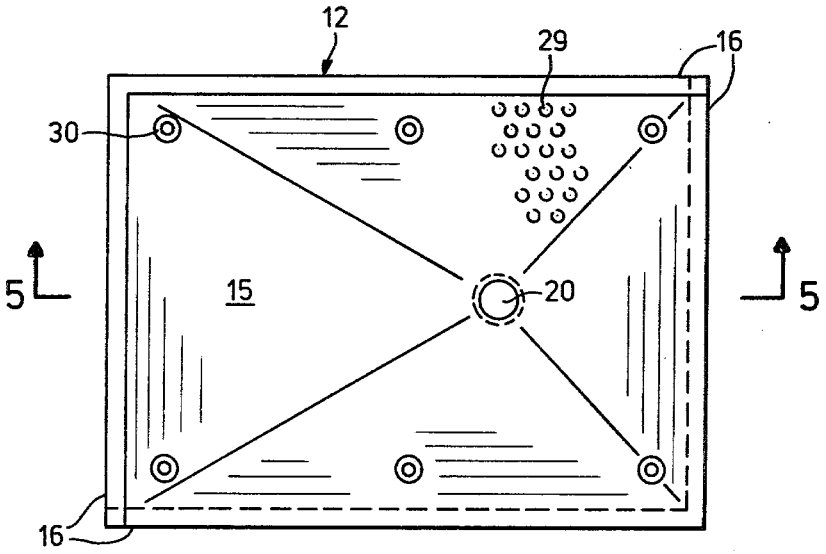
Figure 2:
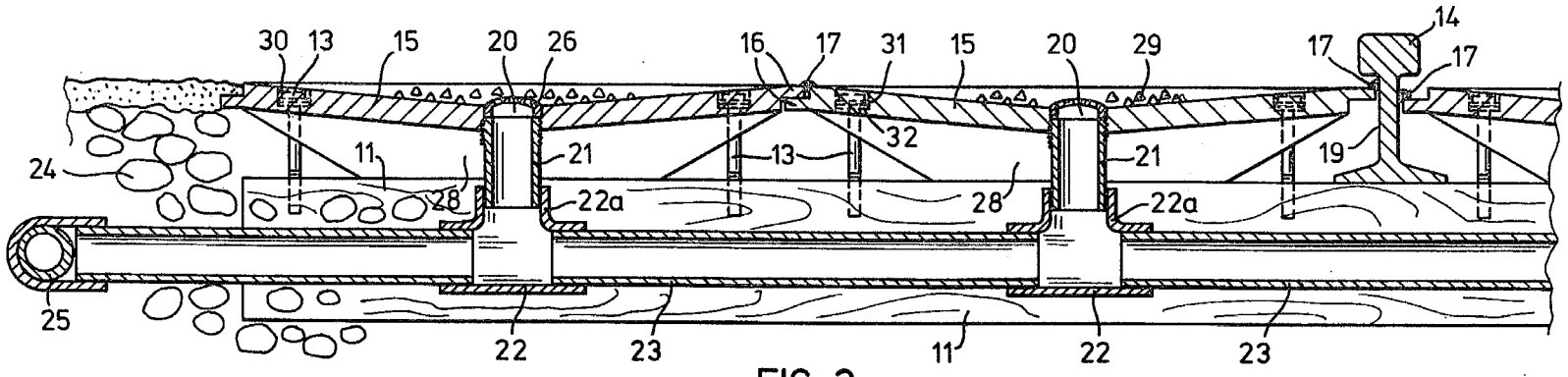
Figure 5:
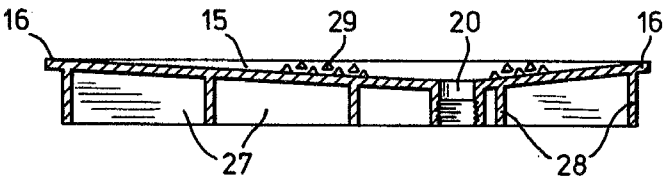
Figure 4:
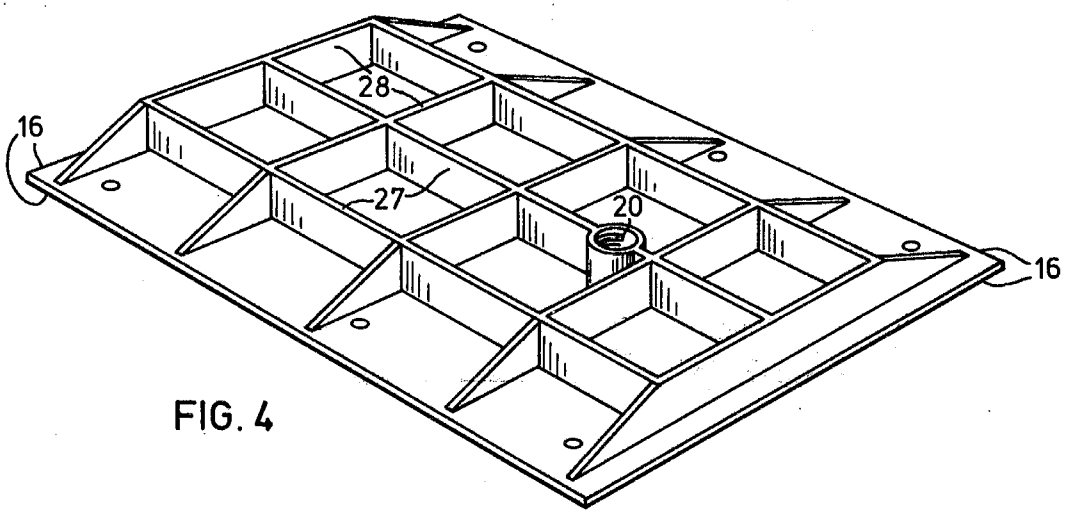

The spillage collector pan and drain system, indicated generally by the numeral 10, is shown by FIG. 1 as installed upon specially spaced and unusually elongate ties 11 of a section of an industrial rail facility at a site used for the loading of industrial liquids, fuels or the like. Identical rectangular shallow pan modules 12 are attached to the ties 11 by lag screws 13 to cover the spaces between mutually adjacent ties both between and along opposite sides of rails 14 of such facility, so that spilled liquid falls upon dished upper surfaces 15 of such pans 12. Edges 16 of the pans 12 are preferably arranged to mate with corresponding edges of adjoining pans and are sealed together, as by caulking material 17. Those edges which abut against vertical webs 19 of rails 14, are similarly sealed as clearly seen in FIG. 2. Each pan 12 has a drain opening 20 formed through its bottom wall and placed so as to discharge caught spillage through a depending nipple 21 and into the upstanding member **22*a* of a tee fitting 22 of a drain pipe 23 which extends between ties 11 and is normally covered by ballast material 24. Nipple 21 is advantageously provided by screwing a short length of pipe into drain opening 20**.

Each drain pipe 23 is capped at one end, as at **23*a*, FIG. 1, and slopes downwardly to connection with a lateral 25, which empties into a collection receptacle (not shown). Grill inserts 26 are fitted into respective drain openings 20**.

Each of the pan modules 12 is preferably molded to formation from a high density polyethylene structural foam so as to have intersecting longitudinal and transverse reinforcing ribs 27 and 28 respectively, extending along and depending from its bottom wall and terminating short of the edge margins thereof to facilitate joinder with other modules and the railroad track, as illustrated, and providing a base for resting upon the supporting ties 11 of the railroad track.

Also as illustrated, opposite ends of one set of ribs are tapered from rib bottoms to pan bottom so as to clear the track base when the module is seated on the tie. The upper, spillage-receiving surface is desirably provided with a nonskid tread 29 molded therein. Countersunk holes 30 are provided for receiving the lag screws 13 together with steel washers 31 and sealing washers 32 of an elastomer material.

Because of the relatively small size and light weight of the pan modules 12, they can be handled easily by a single workman and can be easily removed and replaced when necessary.

Although the illustrated pan modules 12 are of rectangular formation, it should be realized that other shapes will be appropriate in instances of curved railroad tracks. Also, other forms of pans may be utilized as previously indicated, with drainage provided for otherwise than by the provision of depending nipples.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A system for collecting liquid spillage at rail facilities, comprising a plurality of pan modules supported by the ties of a railroad track and secured together substantially fluid tight to provide a liquid spillage collector deck between and alongside the rails of the railroad track, each of said pan modules being molded to shape from a lightweight structural plastic material, being sufficiently small and lightweight to be easily handled by a workman, and each having provision for drainage therefrom; intersecting longitudinal and transverse reinforcing ribs extending along and depending from the bottoms of the respective pan modules as a reinforcing base therefor which rests on the said ties; and conduit means between the ties of the railroad track into which the pans drain.

2. A system according to claim 1, wherein the pan modules are rectangular in shape and are secured together along mutually adjoining edges.

3. A system according to claim 2, wherein the mutually adjoining edges are interfitted in mating relationship and are sealed by caulking material.

4. A system according to claim 3, wherein the pan modules are provided with upper surfaces of non-slip tread formation and reinforcing bases which rest upon the ties.

5. A system according to claim 1, wherein the reinforcing ribs of each pan module terminate short of the edge margins thereof.

6. A system according to claim 5, wherein the set of reinforcing ribs directed toward the rails of the railroad track are tapered from the rib bottoms to the pan bottom.

7. A collector pan module for liquid spillage collecting systems, comprising a pan structure of lightweight structural material having provision for drainage therefrom and being molded to shape from a lightweight structural plastic material and sufficiently small and lightweight to be easily handled by a workman; and intersecting longitudinal and transverse reinforcing ribs extending along and depending from the bottom of said pan structure as a structurally reinforcing supporting base therefor adapted to rest on ties of a railroad track.

8. A collector pan module according to claim 7, wherein the reinforcing ribs of the pan module terminate short of the edge margins thereof.

9. A collector pan module according to claim 8, wherein the set of reinforcing ribs of the pan module that is to be directed toward the rails of the railroad track has its ribs tapered from the rib bottoms to the pan bottom.

10. A pan module according to claim 7, wherein the upper surface thereof is formed as a non-slip tread.

* * * * *